United States Patent [19]

Boyadjieff

[11] 4,449,596

[45] May 22, 1984

[54] DRILLING OF WELLS WITH TOP DRIVE UNIT

[75] Inventor: George I. Boyadjieff, Anaheim, Calif.

[73] Assignee: Varco International, Inc., Orange, Calif.

[21] Appl. No.: 404,896

[22] Filed: Aug. 3, 1982

[51] Int. Cl.[3] ..... E21B 19/06

[52] U.S. Cl. ..... 175/85; 166/77.5; 175/52

[58] Field of Search ..... 175/85, 52; 166/77.5, 166/85; 173/57, 164; 81/57.15, 57.16, 57.24, 57.33, 57.35, 57.38, 57.40

[56] References Cited

U.S. PATENT DOCUMENTS

| | | | |
|---|---|---|---|
| 1,377,575 | 5/1921 | Greve | 173/57 |
| 2,792,198 | 5/1957 | Braun | 173/43 X |
| 2,998,084 | 8/1961 | Johnson et al. | 175/85 |
| 3,009,521 | 11/1961 | Failing | 73/57 |
| 3,053,330 | 9/1962 | Arthur | 175/170 |
| 3,126,063 | 3/1964 | Pitt et al. | 173/152 |
| 3,404,741 | 10/1968 | Gheorghe et al. | 166/77.5 |
| 3,451,493 | 6/1969 | Storm | 175/9 |
| 3,539,024 | 11/1970 | Irons et al. | 175/85 |
| 3,664,439 | 5/1972 | Council | 175/85 |
| 3,680,412 | 8/1972 | Mayer et al. | 81/57.34 |
| 3,708,024 | 1/1973 | Back | 175/52 |
| 3,835,940 | 9/1974 | Winter, Jr. | 173/85 |
| 3,915,244 | 10/1975 | Brown | 166/77.5 X |
| 4,195,698 | 4/1980 | Nakagawasai | 173/44 |
| 4,262,754 | 4/1981 | Nelson | 173/43 |

OTHER PUBLICATIONS

"Descriptive Data-Bowen ES-7 Electric Drilling Swivel and Accessories Equipment", Bowen Tools, Inc., Published: Jul., 1979.

*Primary Examiner*—Ernest R. Purser
*Assistant Examiner*—Thuy M. Bui
*Attorney, Agent, or Firm*—William P. Green

[57] ABSTRACT

Well drilling apparatus including a top drive drilling assembly having a motor driven stem adapted to be attached to the upper end of a drill string and drive it during a drilling operation, a torque wrench carried by the top drive assembly and movable upwardly and downwardly therewith and operable to break a threaded connection between the drill string and the stem, and an elevator carried by and suspended from the top drive assembly and adapted to engage a section of drill pipe beneath the torque wrench in suspending relation. The torque wrench and elevator are preferably retained against rotation with the rotary element which drives the drill string, but may be movable vertically relative to that rotary element and relative to one another in a manner actuating the apparatus between various different operating conditions.

40 Claims, 20 Drawing Figures

DRILLING OF WELLS WITH TOP DRIVE UNIT

BACKGROUND OF THE INVENTION

This invention relates to top drive drilling equipment, and particularly to improved pipe handling apparatus for use therewith.

In a top drive drilling system, there is substituted for the usual rotary table, kelly, and related equipment an assembly which is connected to the upper end of the drill string and moves upwardly and downwardly therewith and has a motor driving a rotary element or stem connected to the string and acting to turn it. The powered top drive assembly is usually guided in its upward and downward movement by tracks or guide elements fixed to the rig derrick or mast.

One type of top drive drilling rig previously utilized includes pipe handling mechanism connected to the bottom of the powered top drive assembly and consisting of a torque wrench and elevator which are attached to the power driven rotary element of the top drive assembly and rotate with it while a well is being drilled. When the rotation of that element and the drill string is stopped, the torque wrench can be utilized to break a threaded connection between the powered rotary element of the top drive assembly and the drill string, and the elevator can be used to suspend a section of pipe during connection to or detachment from the remainder of the string.

This previously devised pipe handling equipment has had several operational disadvantages in use, a number of which have resulted in large part from the fact that the entire pipe handling assembly rotates with the drill string while drilling. For one thing, it must necessarily be extremely difficult in such an arrangement to balance the entire rotating pipe handling assembly with respect to its rotary axis in a manner avoiding the development of vibrational forces or movements as the assembly turns. Also, these rotating non-circular parts can be dangerous to personnel and other equipment, and inherently inconvenient for other reasons. In addition, the prior equipment being discussed is constructed in a manner requiring that the rotation of the torque wrench and elevator be halted in a predetermined rotary position for proper manipulation of the apparatus when the pipe handling equipment is being utilized near the rig floor for making and breaking a connection, and requiring that the wrench and elevator be turned to a different position for engaging and lifting pipe from a rack at an elevated location in the rig. It is frequently very difficult to halt the rotation of a powered top drive assembly at precisely a predetermined rotary position, and thus substantial time and effort can be lost if such controlled rotary positioning is critical. Another disadvantage of the prior equipment resides in the fact that the torque wrench portion of such apparatus is inherently incapable of breaking a threaded connection between the top drive unit and the drill string at an elevated location in the rig since the hydraulic or other connections to the torque wrench which are required for actuating and controlling it must be broken while the torque wrench is rotating with the drill string, and can not conveniently be reconnected near the top of the rig.

SUMMARY OF THE INVENTION

A top drive drilling system embodying the present invention includes pipe handling equipment which greatly facilitates the making and breaking of connections to the drill string when sections are being added to or removed from the string, and which facilitates movement of the sections being added or removed between positions of alignment with the remainder of the string and laterally offset storage positions. The apparatus has a first decided advantage of permitting a connection to be broken between the top drive drilling assembly and an upper section of the drill string at an elevated location in the rig, to thus avoid the loss of time and inconvenience which results when, as in the above discussed prior equipment, the top drive power unit must be lowered to the rig floor each time a connection between it and the drill string is to be broken. The equipment of the present invention includes a torque wrench which can be connected permanently to a source of hydraulic or other power and which can be operated remotely when the wrench and the remainder of the equipment are at any level in the rig. The apparatus additionally is much safer to operate, and does not include massive parts which must rotate with the string during drilling.

A pipe handler constructed in accordance with the invention includes a torque wrench carried by the top drive drilling assembly at the lower end of that assembly, an elevator adapted to engage a section of drill pipe at a location beneath the torque wrench in a relation suspending the pipe section and moving it between different locations, and connecting means attaching the torque wrench and elevator to the top drive assembly for movement upwardly and downwardly therewith, with the connecting means being so constructed that when the elevator is actively engaged with and supporting a section of drill pipe the elevator and that section are suspended from the top drive assembly. The torque wrench preferably does not rotate with the drill string during drilling, and as a result the hydraulic or other power and control connections to the torque wrench may remain attached to the wrench at all times and permit actuation of the wrench for breaking a connection at any level in the rig. Similarly, the elevator preferably does not rotate with the drill string and the drive elements connected thereto. The balancing problems and danger to personnel and equipment which have been encountered in the above discussed prior equipment as a result of rotation of the torque wrench and elevator with the drill string during drilling are thus avoided. Also, these non-rotating parts may be permanently so oriented as to be properly and conveniently accessible to personnel both at the rig floor and at an elevated location in the rig so that there is no requirement for halting rotation of the drill string at a particular point in its three-hundred and sixty degree range of rotary movement to attain a desired orientation as discussed above.

A particular feature of the invention resides in a unique mounting of the torque wrench and elevator for relative vertical movement in a manner such that when these elements and the connected top drive assembly move downwardly to a location near the rig floor, during drilling or under other conditions, the downward movement of the elevator may be halted before the downward movement of the torque wrench is stopped, or stated differently the elevator may be retracted upwardly relative to the torque wrench, with the result that these two units may in their lowermost positions be received in closely proximate relation permitting the torque wrench to apply joint breaking torque to the rotary power driven element of the top drive unit and the drill string as close as possible to the level of the rig floor.

The elevator is desirably suspended from a carrier part which is disposed about the power driven rotary stem of the top drive assembly at a location above the torque wrench, and which is guided for upward and downward movement and restrained against rotation with the drill string by guide means extending downwardly from a non-rotating section or housing of the top drive assembly. In a lower position of this carrier part and the suspended elevator, the weight of these parts and the drill string suspended thereby may be applied to and suspended from the rotary power driven element of the top drive assembly. The apparatus may include spring means or other yielding means normally urging the carrier part and elevator to a somewhat higher position relative to the torque wrench when only a top portion of the drill string and not the entire string are supported by the elevator, to support that top portion from the non-rotating portion of the top drive assembly.

The torque wrench may be actuable to a condition in which it is entirely released from any connection to the drill string during powered rotation of the string, but with the torque wrench being operable or movable to an active condition for applying torque in opposite directions to the drill string and the power driven rotary element of the top drive assembly when the connection therebetween is to be broken. For this purpose, a spline connection may be provided between a section of the torque wrench and the power driven rotary element of the top drive assembly, with this connection being made and released by vertical displacement of the torque wrench.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
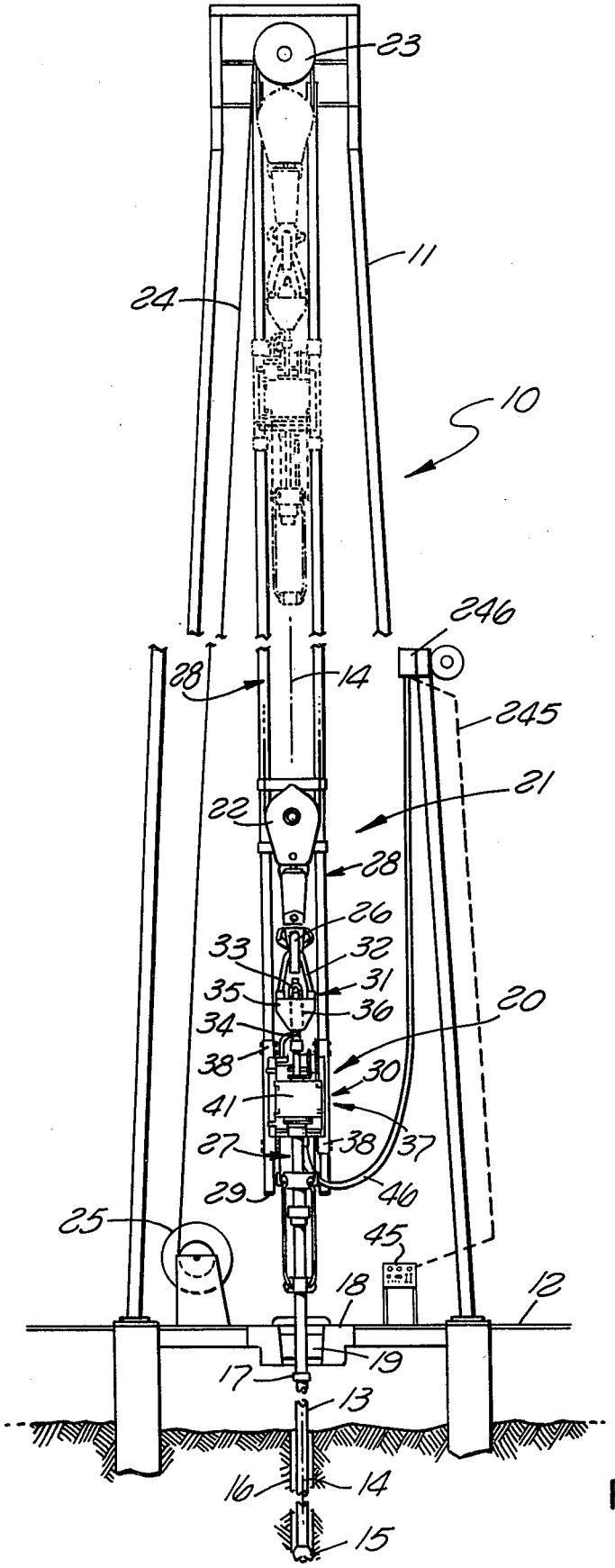
FIG. 1 is a front elevational view showing a well drilling rig having a top drive assembly provided with pipe handling mechanism constructed in accordance with the invention.

The well drilling rig illustrated somewhat diagrammatically at 10 in FIG. 1 includes a mast or derrick 11 which projects upwardly from the rig floor 12. A tubular drill string 13 extends downwardly along a vertical axis 14 and carries a bit 15 at its lower end to drill a well 16 as the string rotates. String 13 is made up of a series of conventional pipe sections interconnected at threaded joints 17. A slip bowl 18 is mounted in the rig floor 12 and has downwardly tapering surfaces engageable with correspondingly tapering surfaces of a series of wedge slips 19 for supporting the drill string while a section of pipe is being added to or removed from the upper end of the string.

The string is driven rotatively during drilling by a top drive drilling assembly 20 suspended by hoisting mechanism 21 including the usual traveling block 22 which is movable upwardly and downwardly relative to crown block by a line 24 pulled by draw works 25. A hook 26 at the lower end of traveling block 22 suspends the top drive drilling assembly. At its underside, drilling assembly 20 carries pipe handling mechanism 27 constructed in accordance with the present invention for making and breaking threaded connections between different sections of the tubular drill pipe and for moving sections of the drill pipe between active and inactive positions.

Figure 5:
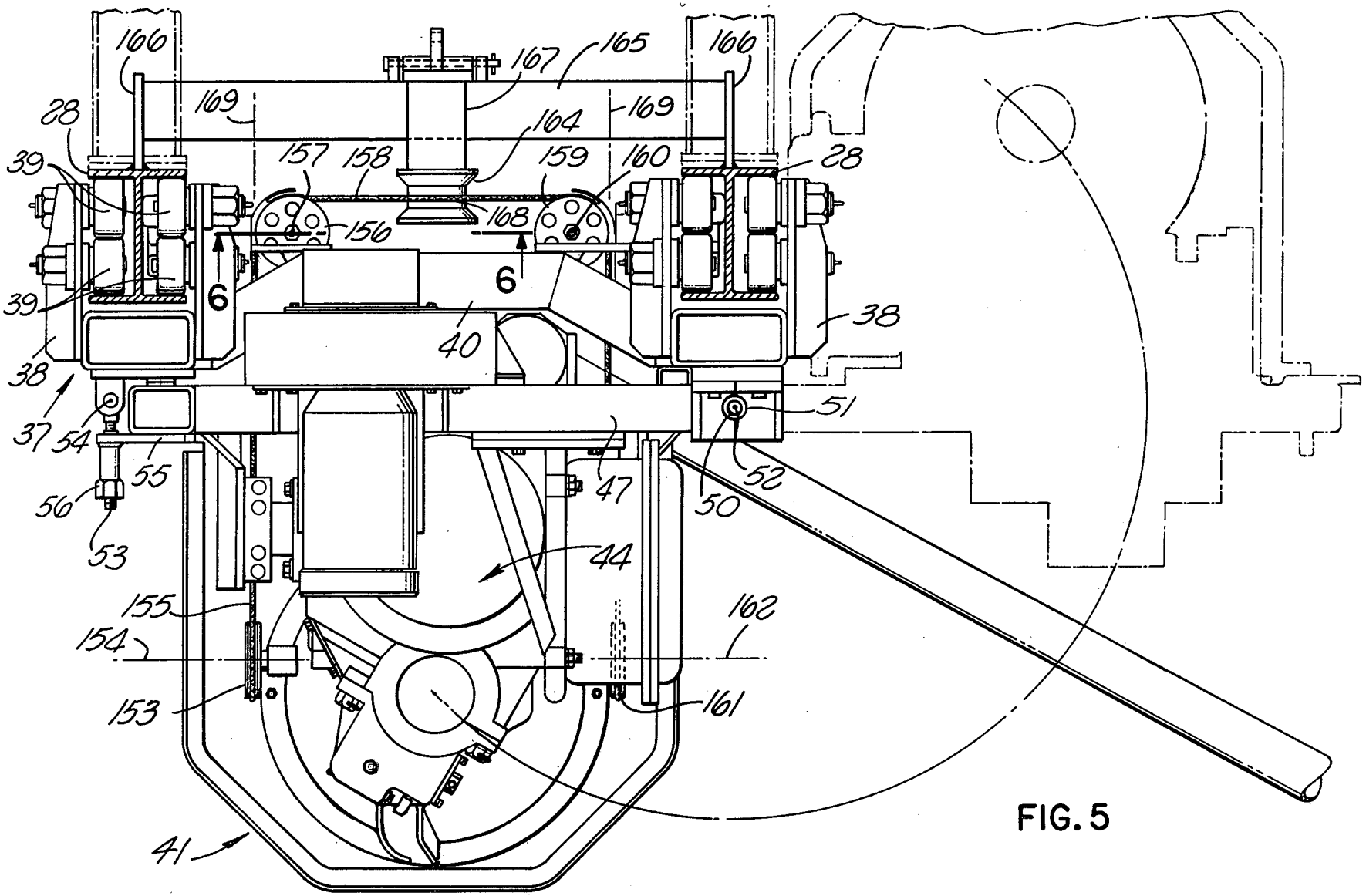
FIG. 5 is a horizontal section taken on line 5—5 of FIG. 2.

The top drive assembly, pipe handler and associated parts are mounted for upward and downward movement along vertical axis 14 by guide means preferably taking the form of two spaced parallel vertical tracks or rails 28 extending parallel to axis 14 and preferably having the I-shaped horizontal sectional configuration illustrated in FIG. 5. These tracks 28 terminate downwardly at lower extremities 29 which may be spaced somewhat above the level of the rig floor. At their upper ends, the tracks may extend upwardly to the top of the The top drive drilling assembly 20 may include a derrick. power unit 30 and a conventional swivel 31 connected to the upper end of the power unit and suspended by connection of its bail 32 to hook 26 hanging from the traveling block 22. Circulating fluid is introduced into the swivel in conventional manner through a gooseneck 33 to flow downwardly through the tubular stem 34 of the swivel which is mounted for rotation relative to the non-rotating swivel body 35. Appropriate bearings 36 are provided in the swivel for rotatably supporting the tubular downwardly projecting stem 34 of the swivel from body 35.

The power unit 30 of the top drive drilling assembly includes a carriage 37 which engages and is guided by tracks 28 for movement vertically along axis 14. This carriage may include two vertically extending structures 38 of essentially U-shaped horizontal section disposed partially about the two tracks 28 respectively as seen in FIG. 5, and each carrying two sets of rollers 39 at the upper and lower ends respectively of the structure 38 for engaging the flanges of the corresponding track 28 in the relation illustrated in FIG. 5 to roll upwardly and downward along the tracks and prevent movement of carriage 37 in any direction except vertically along the tracks. The two side members 38 which carry the track following rollers are rigidly interconnected in any appropriate manner, as by members represented at 40 in FIG. 5.

Mounted to carriage 37, the power unit 30 includes a housing or body 41 which during drilling is fixed rigidly relative to the carriage and retained thereby against rotation about axis 14. A short tubular pipe section or sub 42 is journalled within housing 41 by bearings 43 for rotation relative to housing 41 about vertical axis 14, with those bearings being constructed to function also as thrust bearings retaining housing 41 against vertical movement relative to sub 42 and supporting the weight of housing 41 and a contained motor 44 from the sub. Motor 44 may be electrically energized and act through reduction gears in housing 41 to drive sub 42 rotatively about axis 14 and relative to housing 41 in either rotary direction, under the control of an operator through a remote control console 45 connected to the motor by a line 245 and flexible service loop 46 containing electrical cables and hydraulic lines leading to the vertically movable power unit. The end 246 of loop 46 may be connected to the derrick at a point vertically midway between the rig floor and the upper extremity of the derrick to provide electrical and hydraulic connections to the power unit in all positions thereof.

Housing 41 of the power unit may be attached rigidly to a framework 47, which is in turn pivoted to carriage 37 in a manner mounting the framework 47 and housing 41 and the contained parts for bodily swinging movement between the full line active position of FIG. 5 and the broken line retracted or inactive position of that figure. For this purpose, the carriage may have a pivot pin 48 projecting upwardly into a bearing 49 in the bottom of framework 47, and the upper end of the framework may have an aligned second pivot pin 50 projecting upwardly into and rotatably received within a bushing 51 carried by the carriage, to mount framework 47 and the housing, motor, etc. for swinging movement about vertical axis 52 between the two positions of FIG. 5. At the opposite side of the power unit, framework 47 may be releasably retainable in the active position of FIG. 5 by retaining bolts 53 which are mounted to the carriage to pivot about a vertical axis 54 between the broken line inactive position of FIG. 5 and the full line active locking position in which each bolt 53 is received within a recess 253 in a member 55 carried by framework 47, with a nut 56 on the bolt then being tightenable against member 55 to releasably lock the framework and carried parts in their FIG. 5 active position. The upper end of the tubular sub 42 of power unit 30 is threadedly connected to the lower end of rotary stem 34 of swivel 31, so that fluid from the swivel can flow downwardly into and through the rotary power driven sub or stem 42 of the power unit and to the drill string.

The pipe handling mechanism 27 which is carried beneath top drive drilling assembly 20 includes a tubular sub 57 whose upper end is threadedly connected at 58 to the rotary power driven stem or sub 42 of power unit 30 to be driven thereby, and which has external threads 59 at its lower end connectible to the upper end of drill string 13 to transmit rotary drilling power thereto, with sub 57 containing an internal passage 60 through which drilling fluid is delivered downwardly to the string. The sub 57 may be formed of two sections, including an upper main section 61 and a lower relatively short section 62 threadedly connected at 63 to section 61. Lower section 62 is formed separately from section 61 in order to allow replacement of section 62 if the lower external box threads 59 which connect to the drill string become worn from use. The threads of connection 63 between sections 61 and 62 are desirably of a diameter greater than the diameter of threads 59 and the diameter of the threads at other joints in the drill string, and also the connection at 63 is desirably made up to a torque much higher than that at which the threads 59 are connected to the drill string and the torque at which the other joints in the string are made up, so that during normal handling the connections at threads 59 and between an upper section of the drill pipe and the remainder of the drill string can be broken without detaching the parts at 63.

The lower section 62 of sub 57 has an outer cylindrical surface 64 centered about axis 14, and the upper section 61 has a cylindrical outer surface 65 of the same diameter extending from the upper end of section 61 downwardly to the location of an annular upwardly facing inclined shoulder 66 formed on an externally cylindrical increased diameter enlargement or flange 67 of section 61. Beneath enlargement 67, section 61 has a circular series of axially extending parallel splines 68.

Figure 9:
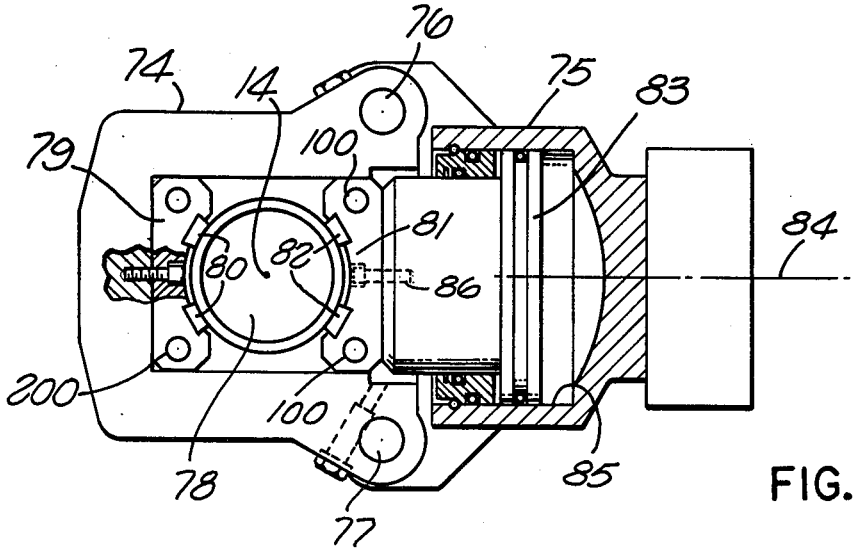

For breaking the threaded connection at 59 between sub 57 and the drill string, the pipe handling mechanism 27 includes a torque wrench 69 which is movably suspended from the non-rotating housing or body 41 of power unit 30 by a hanger assembly 70. The torque wrench includes an upper section or member 71 containing a circular series of axially extending parallel splines 72 (FIG. 7) dimensioned in correspondence with splines 68 of sub 57 and adapted to move into and out of interfitting engagement with those splines to either connect torque wrench section 71 to sub 57 in a fixed relative rotary position, or release sub 57 for rotation relative to and without the torque wrench during a drilling operation. Beneath the upper splined section 71 of torque wrench 69, that wrench includes a lower section 73, which is disposed about and adapted to releasably grip the upper joint end of a top section of drill string 13. As seen in FIG. 9, the lower section 73 of the torque wrench includes a rigid body structure which may be formed of two sections 74 and 75 detachably interconnected by pins 76 and 77 and forming together an opening or passage 78 within which the upper end of the drill pipe is received. A jaw 79 carries gripping elements 80 which are engageable with a first side of the upper joint end of a section of drill pipe, while a second jaw 81 has gripping elements 82 engageable with the opposite side of the joint end. A piston 83 reciprocable along an axis 84 within a cylinder chamber 85 formed in body section 75 is actuable toward and away from the axis 14 of the drill pipe, and is connected to jaw 81 as by screws or other fasteners represented at 86 to hydraulically and controllably move jaw 81 toward and away from jaw 79 to grip and release the pipe. The gripping elements 80 and 82 have teeth or other gripping irregularities capable of applying torque about axis 14 to the gripped joint end.

Figure 3:
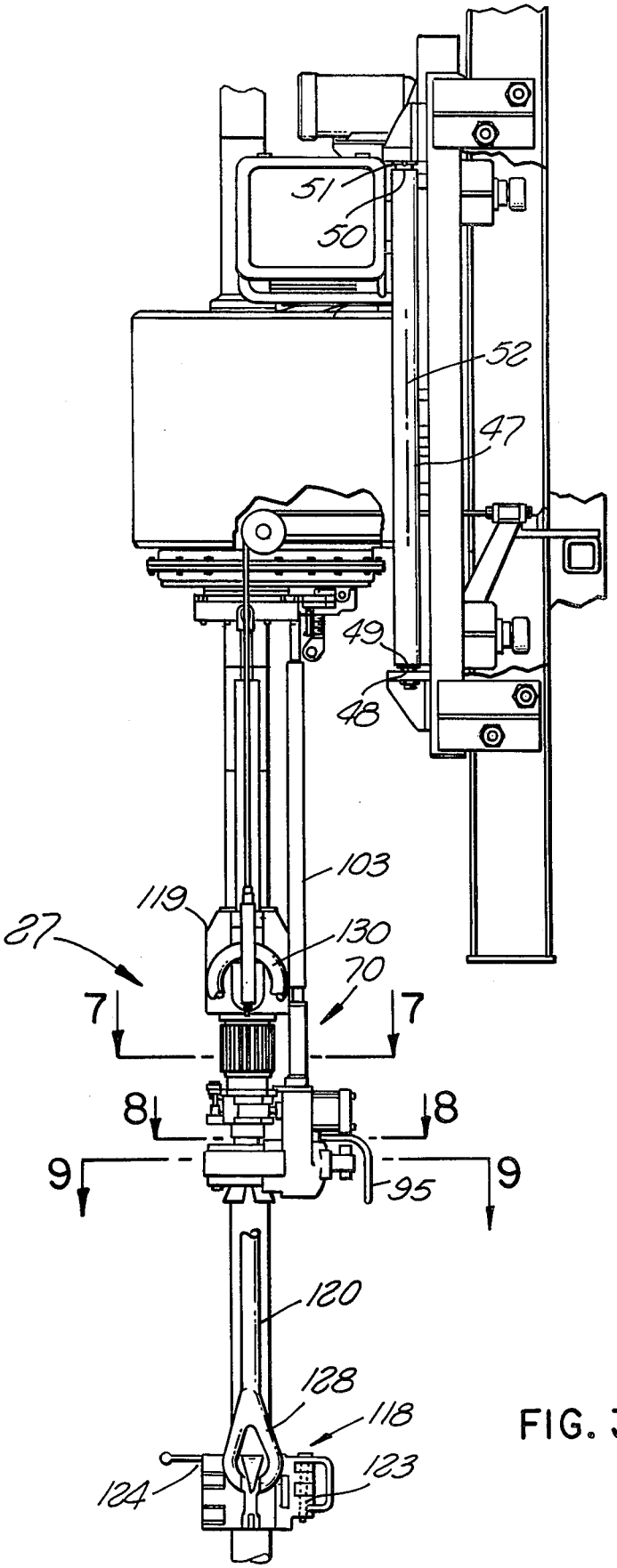
FIG. 3 is a side view of the apparatus taken on line 3—3 of FIG. 2.
Figure 7:
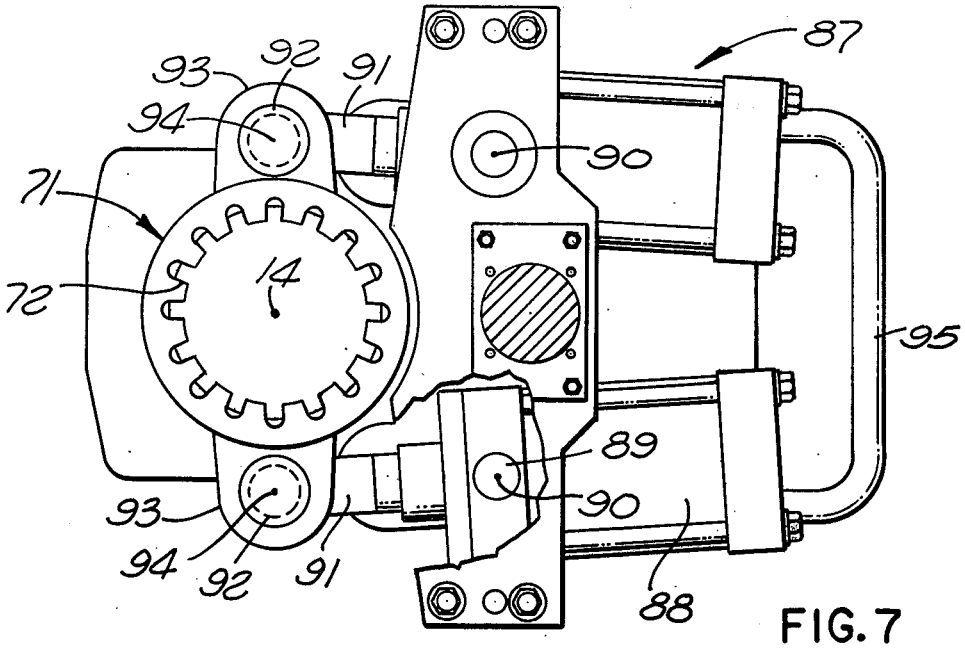
FIGS. 7, 8 and 9 are horizontal sections taken on lines 7—7, 8—8 and 9—9 respectively of FIG. 3.

The lower section 73 of the torque wrench is adapted to be turned rotatively about axis 14 relative to upper section 71 by two preferably hydraulic piston and cylinder mechanisms 87 (FIG. 7), which have their cylinders 88 connected to body part 75 of the lower torque wrench section 73 by trunions 89 mounting the cylinders for slight pivotal movement relative to body section 75 about parallel vertical axes 90. The pistons contained within cylinders 88 have their piston rods 91 connected by pins 92 to diametrically oppositely projecting ears 93 on upper body member 71 of the torque wrench to transmit power from the pistons to member 71 while permitting pivotal movement of the piston rods relative to ears 93 about parallel vertical axes 94. A guard 95 may project rightwardly and downwardly from body 75 as illustrated in FIGS. 3 and 7. Two tapering bell segments 96 may be attached to and project downwardly from body 74 of the lower section of the torque wrench to provide a downwardly flaring internal throat into which the upper end of a drill pipe section can be stabbed to center that section within the torque wrench as the pipe section and wrench are moved axially relative to one another. Hydraulic fluid is supplied to cylinders 85 and 88 through service loop 46 to allow the torque wrench to be actuated into and out of gripping engagement with the well pipe by actuation of control elements at the remote console 45, and to allow pressure fluid to be supplied to the two cylinders 88 selectively for forcibly turning the lower section 73 of the torque wrench about axis 14 relative to upper section 71 in either direction to make or break the threaded connection at 63 as desired.

Figure 8:
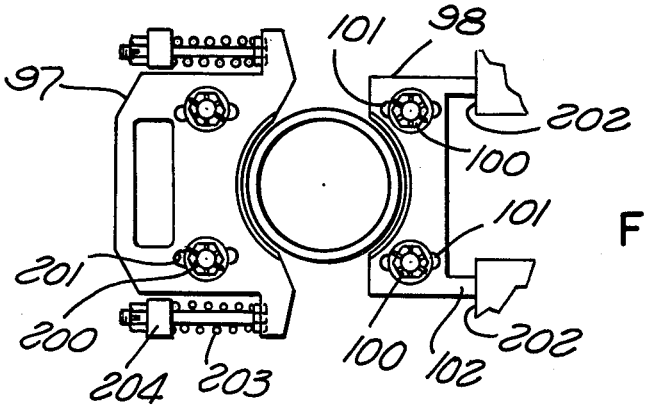
Figure 10:
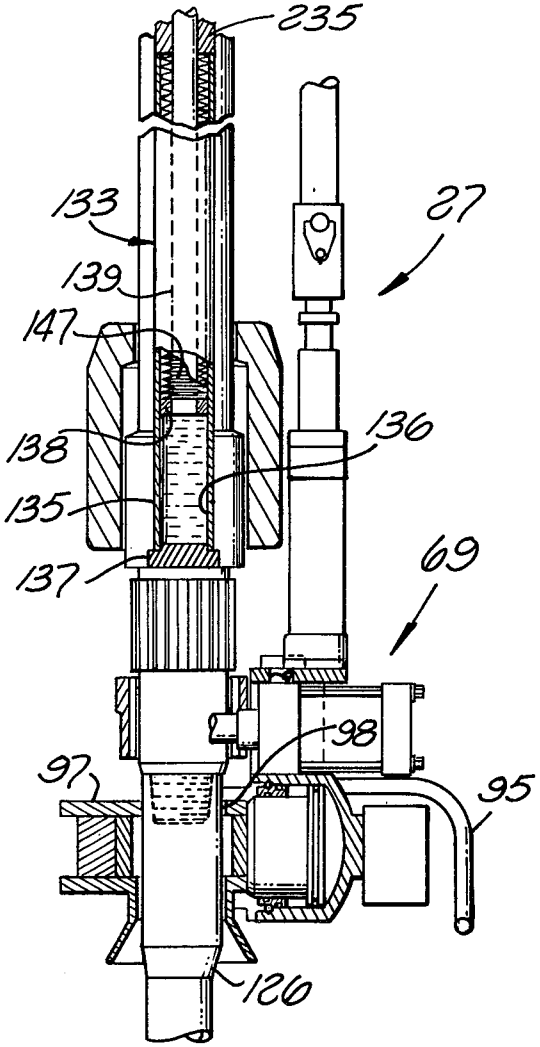

When the gripping elements of the torque wrench are released, and the drill string is being driven rotatively relative to the wrench, the torque wrench may be centered relative to the drill string and axis 14 by two parts 97 and 98 carried at the top of body part 74 of the lower section of the torque wrench. These elements 97 and 98 may have inner curved surfaces 99 (FIG. 8) which are engageable with the outer surface of the upper joint end of the top drill string section, and which center the drill string relative to the torque wrench in a manner preventing contact of the rotating drill string with any other portion of the wrench and thus avoiding wear of any parts other than the replaceable elements 97 and 98. Part 98 may be movably secured to the top of jaw 81 by two bolts 100 extending vertically through the jaw and through slots 101 in part 98 in a manner enabling jaw 81 in its active pipe gripping position (FIG. 11) to project beyond edge 99 of part 98 into engagement with the pipe. When jaw 81 is retracted rightwardly as viewed in FIG. 10, engagement of portions 102 of part 98 with two shoulders 202 (FIG. 8) formed on body part 75 limits rightward movement of part 98 while piston 83 and jaw 81 continue to move far enough to retract gripping elements 82 rightwardly beyond edge 99 of part 98 (FIG. 10), so that edge 99 may locate the rotating pipe string while protecting gripping elements 82 from contact therewith as discussed.

Part 97 is attached to jaw 79 by two screws 200 extending vertically through the jaw and through slots 201 formed in part 97 and permitting movement of part 97 leftwardly and rightwardly relative to the jaw. Springs 203 bearing in opposite directions against part 97 and shoulders 204 on body part 74 yieldingly urge part 97 rightwardly relative to part 74 and jaw 79 toward the FIG. 10 position of projection beyond gripping elements 80 to engage and center the pipe during drilling, but with part 97 being actuable to the retracted position of FIG. 11 leftwardly beyond gripping elements 80 when the pipe is gripped by elements 80 and 82 of the torque wrench. The bolts 100 and 200 may also serve to secure bell sections 96 movably to the bottoms of jaws 79 and 81 as by providing the bell sections with flange portions 97*a* and 98*a* through which screws 100 and 200 extend. These flange portions 97*a* and 98*a* may contain slots corresponding to slots 101 and 201 in parts 97 and 98, to allow movement of parts 97*a* and 98*a* and their carried bell portions 96 in the same manner as parts 97 and 98 and with part 97 being yieldingly urged rightwardly by springs corresponding to springs 203 associated with part 97.

Figure 12:
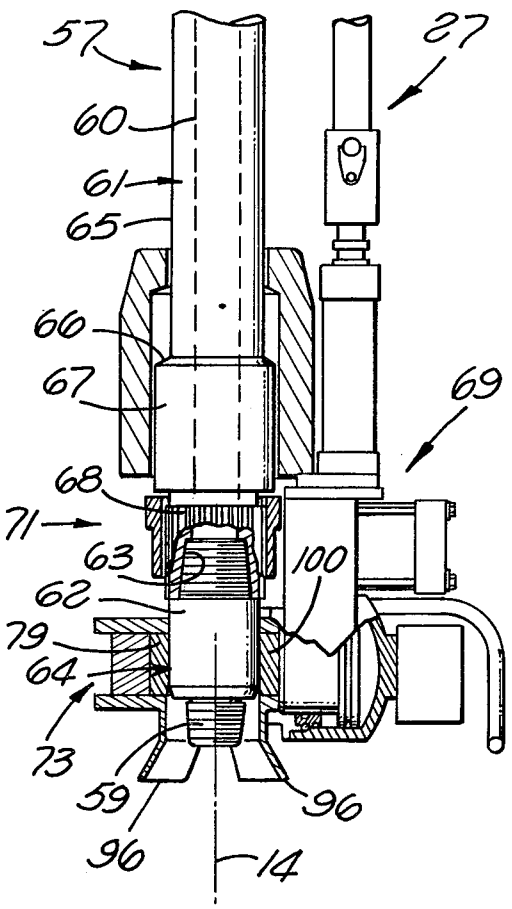
FIGS. 10, 11 and 12 are enlarged fragmentary vertical sections taken on line 10—10 of FIG. 2 and showing the apparatus in three different conditions.

The hanger member 70 which suspends torque wrench 69 from the powered top drive assembly includes a rigid vertically extending member 103, having a bifurcated connecter portion 104 at its upper end adapted to be attached by a pin 105 to an annular downwardly projecting cylindrical portion 106 of the non-rotating housing 41 of power unit 30. Pin 105 may extend through registering apertures in the interfitting connector structures 104 and 106, with the pin having a tab 107 retained by a screw or other fastener 108 to secure the pin against detachment from the other parts. At its lower end, vertical member 103 of hanger 70 is connected to the piston 109 of a piston and cylinder mechanism 110 whose cylinder 111 has its lower end rigidly connected to member 75 of the lower section of the torque wrench. The rod 112 of piston 109 has its upper end threadedly connected at 113 to a screw 114 whose upper large diameter end is threadedly connected at 115 to a part 116 attached to the lower end of member 103. When hydraulic fluid is supplied under pressure to the upper end of cylinder 111, above piston 109, the cylinder is forced to move upwardly relative to the piston in a manner bringing splines 72 and part 71 into interfitting engagement with splines 68 on the rotary sub 57, to prevent rotation of sub 57 relative to part 71. A tube 117 disposed about rod 112 of piston 109 limits such upward movement of the torque wrench, by engagement at its lower end with cylinder 111 and at its upper end with a flange 214 on part 114, in the FIG. 11 position in which the splines interfit only partially. In that position, the gripping elements 80 and 82 of the lower section 73 of the torque wrench are at a level to engage and grip the upper joint end of the top section of the drill pipe. If tube 117 is removed, as seen in FIG. 12, the piston and cylinder mechanism 110 when actuated will move the torque wrench upwardly far enough to cause the splines 68 and 72 to fully interfit with one another and bring the gripping elements of the lower torque wrench section 73 to a level to engage and grip the short lower section 62 of sub 57, so that the torque wrench may then be utilized to make or break the connection at 63 between sections 61 and 62 of the sub.

In addition to the torque wrench 69 and related parts thus far described, the pipe handling mechanism 27 also includes an elevator 118 beneath the torque wrench and a carrier part 119 located above the torque wrench and from which the elevator is suspended by links 120. The elevator may be of conventional construction, preferably consisting of two halves 121 and 122 hinged together by a pin 123 for relative pivotal opening and closing movement about the vertical axis of the pin to enable the two halves of the elevator to completely encircle a drill pipe section when closed and to be moved laterally onto and off of that drill pipe section when opened. A latch mechanism 124 may be provided at the free ends of the two halves of the elevator to releasably retain them in closed condition about the pipe. The elevator is preferably of a type forming an upwardly facing shoulder 125, consisting of two semicircular partial shoulders formed on the two sections 121 and 122 respectively and forming an essentially annular composite shoulder when the two sections are closed. This annular shoulder may flare upwardly at an angle corresponding to the annular undersurface 126 of a joint end of the drill pipe, to engage that surface in a manner suspending the drill pipe section from the elevator. The two halves of the elevator may be shaped to form loops 127 at diametrically opposite locations to which loops 128 formed at the lower ends of links 120 are connectible, with the connection being maintained by removable closure elements 129 extending across the outer open sides of the loops 127 on the elevator. Similarly, the links 120 have loops 130 at their upper ends connectible to loop or eye portions 131 formed at diametrically opposite locations on carrier part 119 above the torque wrench. Closure elements or straps 132 may close these loops 131 on the carrier part.

Figure 2:
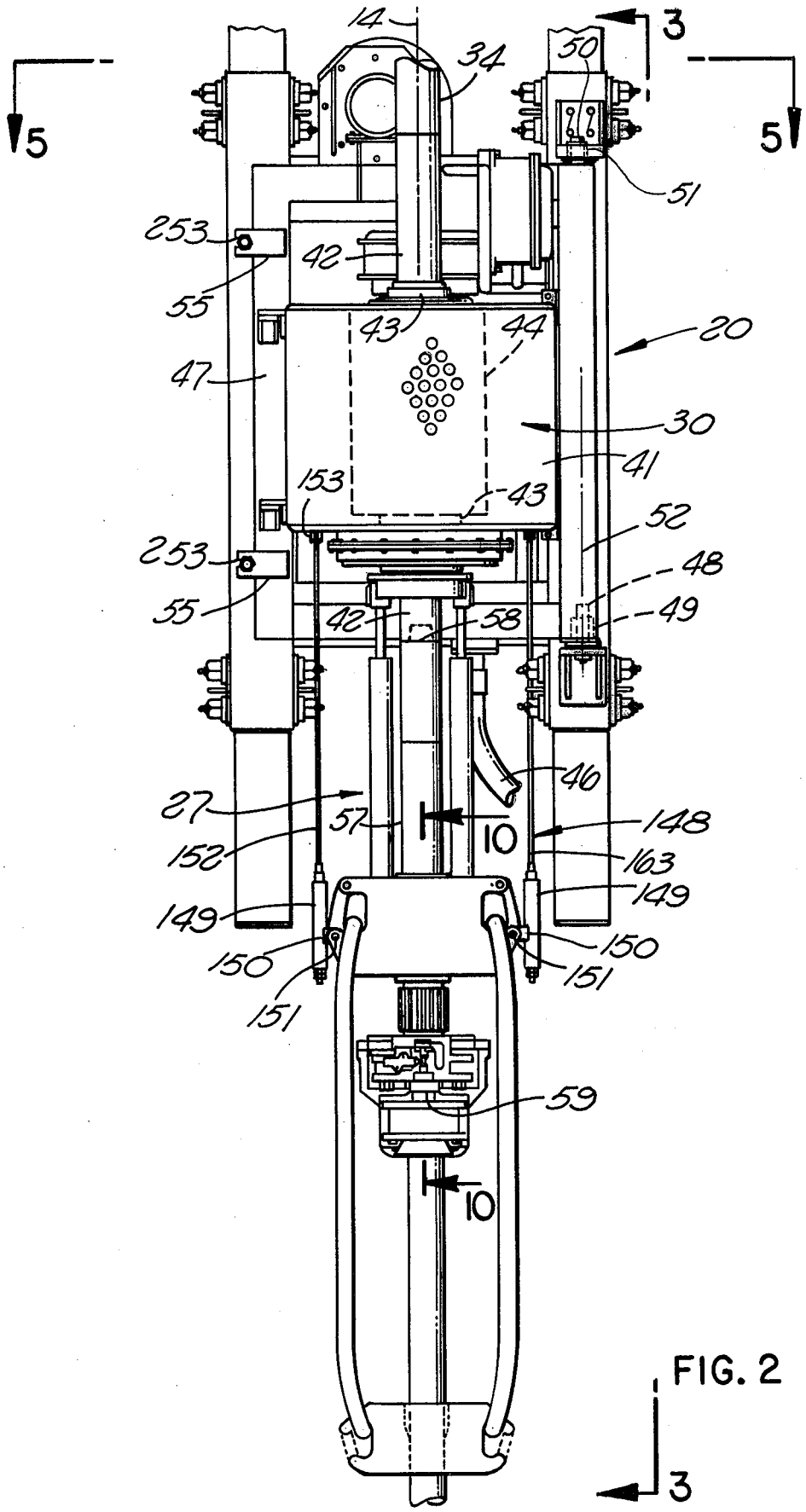
FIG. 2 is an enlarged elevational view corresponding to a portion of FIG. 1.
Figure 4:
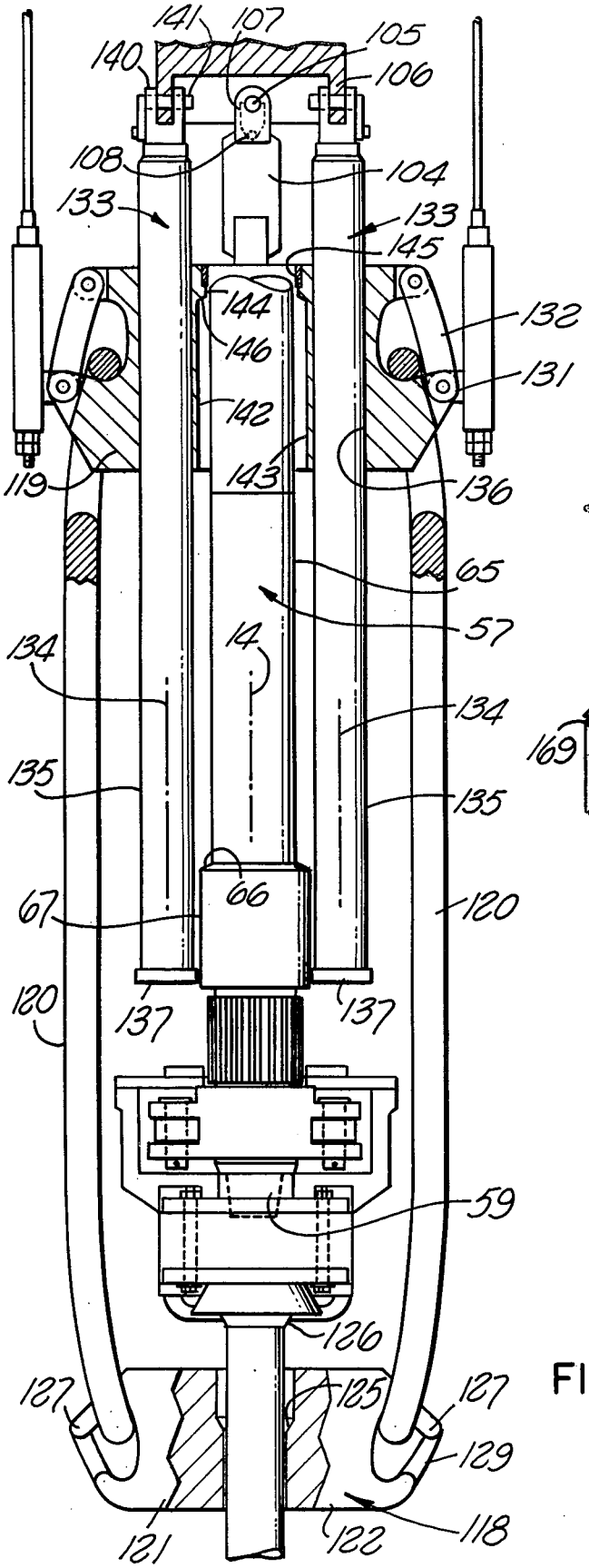
FIG. 4 is a view corresponding to a portion of FIG. 2, but showing the elevator in its retracted position closely proximate the torque wrench.

Part 119 and the suspended elevator 118 are adapted to be retracted upwardly relative to the torque wrench between the normal position of FIGS. 2 and 3 and the retracted position of FIG. 4. The parts are guided for this upward and downward movement and restrained against rotary movement about axis 14 by two torque arresting assemblies 133 extending vertically along two parallel vertical axes 134 at diametrically opposite sides of main well axis 14. Each of these assemblies 133 includes a vertical cylinder 135 centered about one of the axes 134 and slidably received within one of two vertical cylindrical passages 136 in carrier part 119. Annular enlargements or flanges 137 at the lower ends of cylinders 135 limit downward movement of carrier part 119 relative to the cylinders in the FIG. 2 position of the parts, while permitting upward movement of the carrier parts slidably along the cylinders to the FIG. 4 position. Each cylinder 135 contains a piston 138 which is movable upwardly and downwardly therein and has a rod 139 projecting upwardly from the upper end of the cylinder and having a bifurcated connector portion 140 attachable by a pin 141 to the previously mentioned lower mounting ring portion 106 of the nonrotating housing 41 of power unit 30 in a manner similar to the previously discussed connection between the torque wrench suspending hanger 70 and portion 106.

Figure 11:
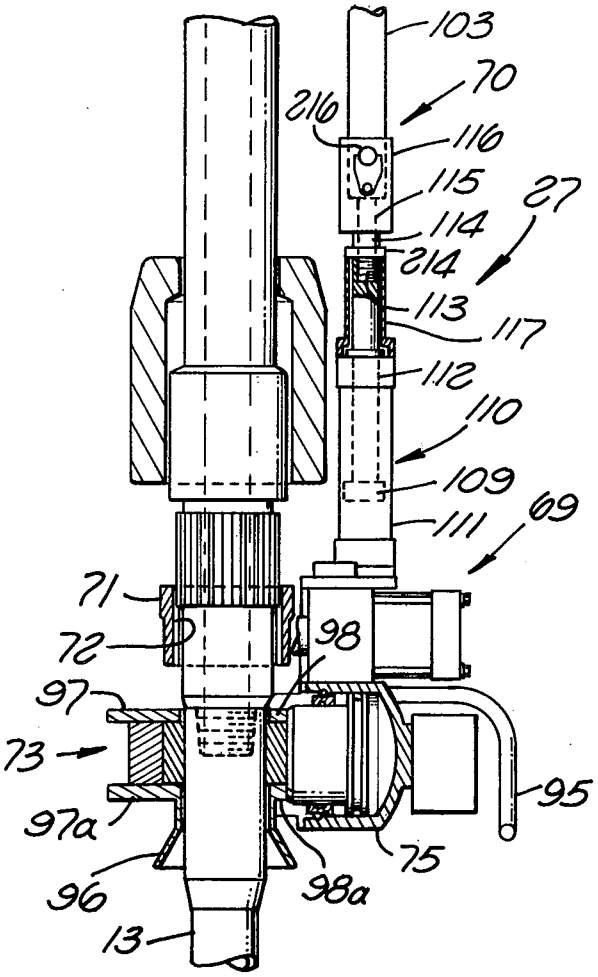

The tubular sub 57 extends vertically through a central passage 142 in part 119, having a lower cylindrical portion 143 within which the enlargement 67 on the sub is movably received and confined, and having a reduced diameter upper circular portion 144 within which the upper externally cylindrical reduced diameter portion 65 of the top section of the sub is received. An annular bushing element 145 carried by the upper portion of part 119 may closely engage the sub to journal it for rotation within and relative to part 119 and assist in guiding part 119 for its upward and downward movement. At the juncture of the two portions 143 and 144 of passage 142, part 119 forms a downwardly facing annular preferably inclined shoulder 146, disposed at an angle corresponding to shoulder 66 on the sub and adapted to engage that shoulder in a manner supporting part 119 and the suspended elevator from sub 57 in certain conditions of the apparatus. When the entire weight of the drill string is supported by the elevator, these shoulders are in such engagement. However, at other times, as for instance when only a stand of drill pipe detached from the remainder of the string is supported by the elevator, the shoulder 146 is automatically maintained above the level of shoulder 66 as illustrated in FIG. 11. Retention of part 119 and its shoulder in this slightly elevated condition is attained by provision in the cylinders 135 of a series of Belleville washers 147 which may be disposed about the piston rods 139 above pistons 138, and act to apply yielding force in opposite directions against the pistons and the upper ends 235 of the cylinders to urge the cylinders upwardly relative to the pistons to the FIG. 11 position of the parts. In this condition of the apparatus, the weight of the carrier part and elevator and a drill pipe section are suspended from the non-rotating body or housing of power unit 30 yieldingly through torque arrester assemblies 133. When the drilling assembly moves downwardly to a location near the rig floor, it is desirable that the elevator and torque wrench move progressively closer together axially, so that in the lowermost position of the parts both the torque wrench and the powered drilling unit can move as close to the level of the rig floor as possible, as to the condition represented in FIG. 4. This serves the purpose of maximizing the range of vertical movement of the drilling apparatus, and also enabling detachment of the drilling unit from the drill string at a point close enough to the rig floor and slips 19 to avoid any possibility of distortion of the string or its upper joint end while making or breaking a connection. To attain such automatic movement of the elevator and torque wrench relatively toward one another in the lowermost positions of the drilling apparatus, the apparatus preferably includes a flexible cable or other elongated flexible element 148, which has connector parts 149 at its opposite ends provided with eyes 150 attachable by bolts or pins 151 to carrier part 119 at diametrically opposite locations. Extending upwardly from one of these connector elements 149, the cable has a vertical portion 152 which passes first about a sheave 153 mounted to the nonrotating housing 41 of power unit 30 for rotation about a horizontal axis 154. After extension about the upper side of this sheave 153, the cable extends at 155 (FIG. 5) to a sheave 156, which is mounted to the frame 47 carrying housing 41 for rotation about a normally vertical axis 157, to then extend horizontally at 158, then about a sheave 159 mounted to frame 47 for rotation about a normally vertical axis 160, and then about a sheave 161 mounted to housing 41 for rotation about a horizontal axis 162, from which the cable extends downwardly at 163 to its second point of attachment to part 119.

Figure 6:
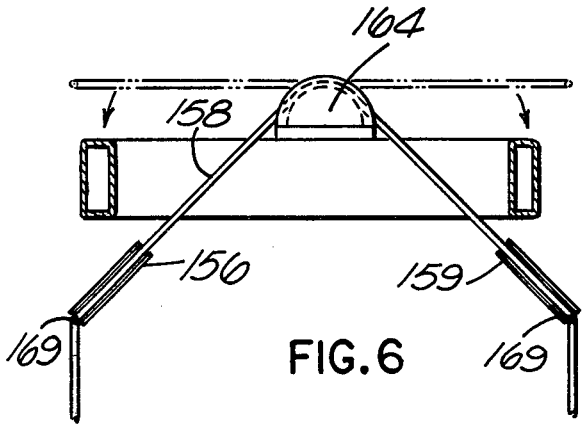
FIG. 6 is a fragmentary vertical section taken on line 6—6 of FIG. 5.

When the drilling motor and other associated parts reach a predetermined position near that of FIG. 4 during downward movement of the drilling equipment, the transverse central portion 158 of cable 148 engages a stationary part 164 which is appropriately mounted in fixed position relative to tracks 28 at a location essentially midway laterally between those tracks. As seen in FIG. 5, this mounting of part 164 may be attained by providing a transverse rigid support member 165 attached at its opposite ends to members 166 welded to the back sides of the tracks respectively. Part 164 may be carried by an element 167 projecting forwardly from support member 165, and may contain a semicircular upwardly facing groove 168 within which the central portion of the cable is received when the drilling apparatus reaches a predetermined level. Upon further downward movement of the top drive powered drilling apparatus relative to part 164, the central portion of the cable engaged by that part is retained thereby against downward movement with the remainder of the cable, causing the cable ends 152 and 163 to be pulled upwardly toward sheaves 153 and 161, and thus retract carrier part 119 upwardly relative to and toward housing 41 to the FIG. 4 relative position, or stated differently acting to halt downward advancement of carrier part 19 and the suspended elevator while the torque wrench and connected parts continue their downward advancement to positions of close proximity to the elevator. During this cable controlled actuation of the elevator, the sheaves 156 and 159 may be mounted to pivot bodily about parallel horizontal axes 169 (FIGS. 5 and 6) in order to properly engage the cable as the portions of the cable between part 164 and sheaves 156 and 159 change from horizontal condition to inclined or more vertically extending condition.

Figure 13A:
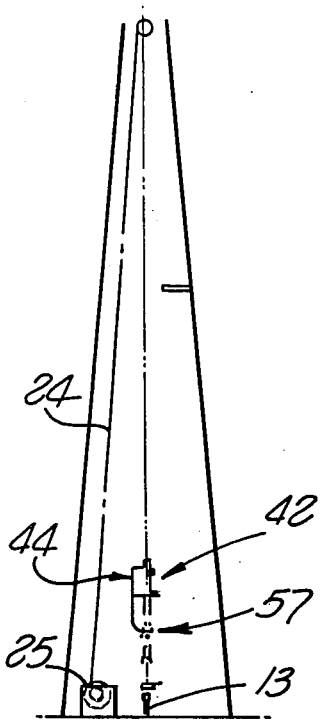
FIGS. 13A, 13B, 13C, 13D and 13E are views representing diagrammatically a series of steps in the process of adding a stand of pipe to the drill string utilizing the present apparatus.

During a drilling operation, the rotary power driven stem 42 of the top drive assembly is connected to sub 57 of the pipe handling mechanism, which in turn is connected threadedly to the upper end of drill string 13. While drilling fluid is pumped downwardly through the entire length of these parts, the elements 42 and 57 and the connected drill string 13 are driven rotatively by motor 44 to progressively drill the well. This apparatus is all suspended from the rig derrick by traveling block 22 and line 24, with draw works 25 (FIG. 13A) progressively paying out the line to lower the top drive assembly as the bit advances within the hole. The elevator may be suspended by the top drive equipment in the position of FIGS. 2 and 3, until the equipment reaches a location at which the elevator is very near to the rig floor, at which time the central portion of cable 148 contacts part 164, and is restrained by that part against further downward movement, causing the elevator to remain essentially in its position of close proximity to the rig floor while the motor, torque wrench and other related parts continue their downward movement to the FIG. 4 position. With the parts in that FIG. 4 condition, the driller sets the slips 19 on the drill string just below the upper end of the upper section of that string, to suspend the string by means of those slips.

Figure 13B:
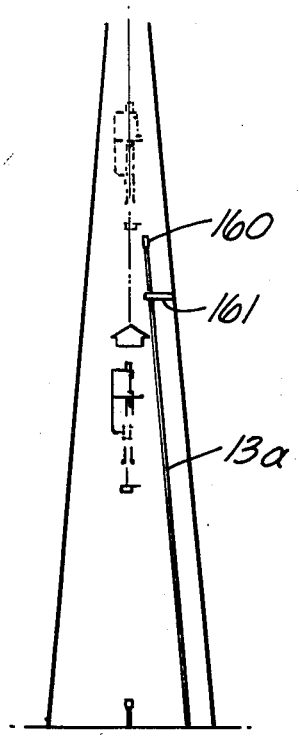
Figure 13C:
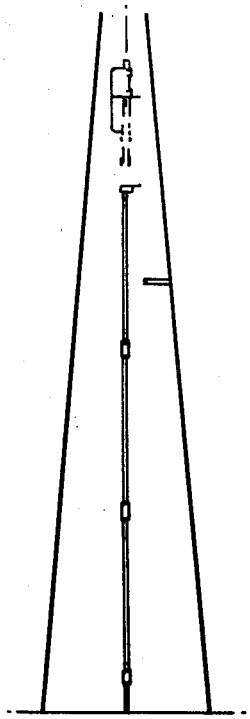
Figure 13D:
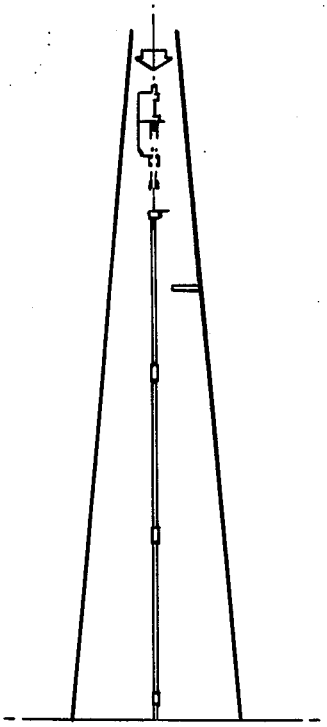
Figure 13E:
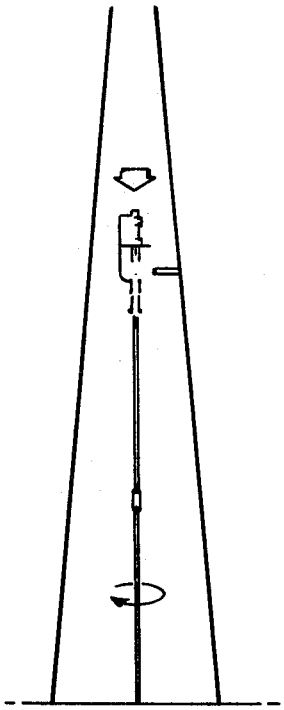

The circulation of drilling fluid through the string is halted, and the sub 57 is broken out from the top end of the drill string. To effect this detachment of sub 57, the driller actuates controls at console 45 serving to first apply pressure fluid to piston and cylinder mechanism 110 in a manner raising the torque wrench 69 from the position of FIGS. 2 and 4 to the elevated level of FIG. 11, bringing splines 72 into partially overlapping interfitting engagement with splines 68, after which pressure fluid is supplied to cylinder chamber 85 to cause the lower section of the torque wrench to grip the upper end of the top section of the drill string. Pressure fluid is then supplied to the piston and cylinder mechanisms 87 to forcibly turn the upper section 71 of the torque wrench relative to the lower section 73, in a direction applying torque in opposite directions to sub 57 and the top section of the drill string forcibly unscrewing these parts from their tightly engaged condition. After the threaded connection has thus been broken, the pressure fluid to the various portions of the torque wrench and its elevating piston and cylinder mechanism 110 is released to lower the torque wrench out of engagement with splines 68 and release the gripping engagement of the lower section of the torque wrench with the top section of the pipe string. Motor 44 is then energized to spin sub 57 rapidly in a direction unscrewing that sub completely from the upper end of the drill string. With the elevator open, the top drive drilling assembly is then elevated by the draw works and related hoisting mechanism from the position illustrated in FIG. 13A through positions such as that represented in full lines in FIG. 13B and to the elevated position represented in broken lines in that figure in which the elevator is above the upper end 160 of a stand of pipe **13*a* in a rack 161 in the side portion of the derrick. The elevator is then swung over to a position in which it can be received about the upper portion of the stand 13*a* at a location just beneath it enlarged upper joint end, in which condition the elevator is closed about that stand and the draw works are actuated to pull the elevator and other related parts upwardly in a manner lifting the stand 13*a* by means of the elevator and allowing it to swing to a position in which its lower end is directly above the upper end of the top section of drill pipe in the string. The apparatus is then lowered to stab the bottom end of the suspended stand into the upper end of the string at floor level, as represented in FIG. 13C, after which the top drilling assembly and pipe handling mechanism are lowered relative to the stand as represented in FIG. 13D until the lower end of sub 57 of the pipe handling mechanism has its threads 59 received within the upper box end of stand 13*a*, for threaded connection to that stand. The motor 44 is then energized by the operator to rotate sub 57 rapidly in a manner spinning it into the upper end of stand 13*a*, and then by virtue of that connection spinning the lower externally threaded box end of stand 13*a* into the upper end of the drill string at floor level, with this rotation developing sufficient torque to effectively make up the connections at both the upper and lower ends of stand 13*a* to a properly torqued condition. The top drive assembly may then be raised slightly by the draw works to allow removal of slips 19** at the rig floor level, freeing the string for powered rotation by the top drive unit to continue drilling of the well.

Figure 14A:
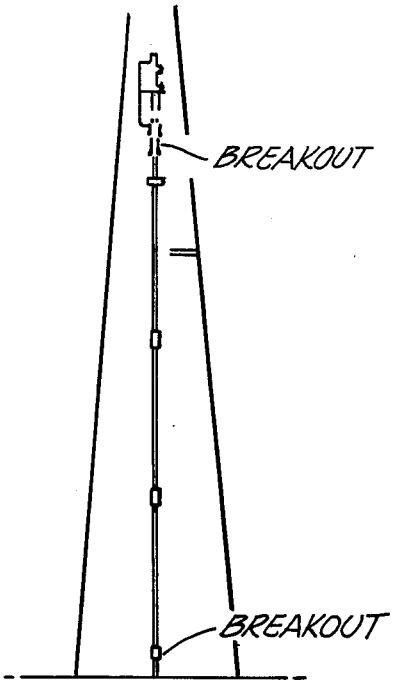
FIGS. 14A, 14B and 14C illustrate diagrammatically a series of steps in the process of removing a stand of pipe from the drill string.
Figure 14B:
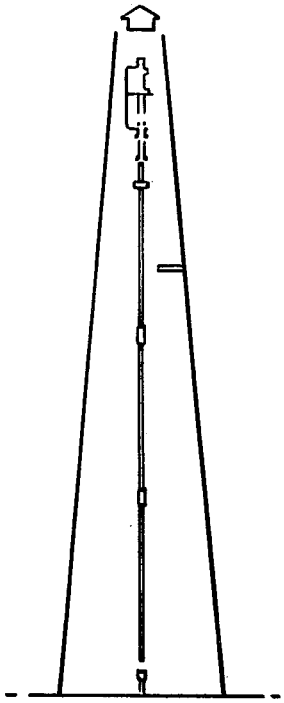
Figure 14C:
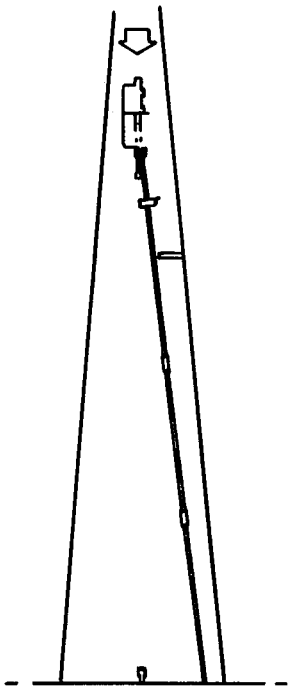

A stand can be removed from the upper end of the drill string by a process which is essentially the reverse of that described above. As illustrated in FIGS. 14A through **14*c*, when it is desired to remove an upper stand of pipe, the top drive apparatus may be elevated by the draw works and traveling block to a position such as that shown in FIG. 14A, in which the lower end of the stand to be removed is just above floor level. This elevation may be performed while maintaining circulation and maintaining rotation to ream out of the hole. When the apparatus reaches the FIG. 14A position, slips 19 are set to suspend the string just below the stand to be removed, after which the joint at the lower end of that stand is broken out from the remainder of the string by tongs or other equipment and then spun out from the string. The connection between the upper end of the stand to be removed and sub 57 of the pipe handling equipment is then broken utilizing the torque wrench 69, by first elevating the wrench as discussed and then actuating it to grip the upper end of the stand to be removed and then relatively rotate sections 71 and 73 of the torque wrench to apply torque in a direction unscrewing sub 57 from the stand. The sub 57 is then spun out from the stand by rapidly rotating it utilizing motor 44. Prior to this detachment of the parts, elevator 118 has been closed about the stand to be removed beneath its upper enlarged joint end, so that when the sub 57 is detached from the stand the latter will be suspended by the elevator as represented in FIG. 14B. The draw works are actuated to raise the top drive drilling equipment and the elevator in a manner hoisting the free stand from the drill string, with the stand then being swung to the FIG. 14C position in which it is stored in the rack. After the stand is properly retained in the rack, the elevator is unlatched to an open condition for removal from the stand, and the apparatus is then lowered to stab the tubular sub 57 into the next section of the drill string, with the sub then being spun into that section by motor 44** with enough torque to make up the connection to a torqued condition for elevation of the string high enough to remove the next successive stand, etc.

FIG. 12 ilustrates the manner in which the torque wrench can be utilized for removing the lower short section 62 of sub 57 from the upper section 61 of that sub, in order to allow replacement of section 62 if its threads 29 become worn from extended use. When such removal of section 62 is desired, the apparatus is first placed in condition for use in the FIG. 12 manner by removal of stop sleeve 117 from its normal position about piston rod 112. To enable removal of the sleeve, the sleeve is slotted along its axis and retained by bolts to cylinder 110. With tube 117 removed, the piston and cylinder mechanism 110 can be actuated to pull the torque wrench upwardly beyond the position of FIG. 11 and to the position of FIG. 12 in which splines 72 are fully engaged with splines 68, and in which the gripping elements carried by jaws 79 and 100 are at a level to be forced against lower section 62 of sub 57 by fluid actuation of piston 83, to grip section 62 and hold it against rotation while part 71 is turned by piston and cylinder mechanisms 87 to rotate section 61 relative to section 62 in an unscrewing direction for removal of section 62 from section 61. The parts can be reconnected when desired by reverse actuation of the parts.

While a certain specific embodiment of the present invention has been disclosed as typical, the invention is of course not limited to this particular form, but rather is applicable broadly to all such variations as fall within the scope of the appended claims.

I claim:

1. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator;

connecting means attaching said torque wrench and said elevator to said top drive assembly for movement upwardly and downwardly therewith and in a relation suspending said torque wrench and said elevator and a section of the drill string carried by the elevator from said top drive assembly;

said connecting means being constructed to enable movement of said torque wrench and elevator vertically relative to one another.

2. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means including means for actuating said torque wrench upwardly and downwardly relative to said element between an active position in which portions of said torque wrench and said element interfit to retain said element against rotation relative to said portion of the torque wrench and a released position permitting such rotation.

3. Well drilling apparatus comprising:

a top drive assembly to be received at the upper end of a drill string and which is movable upwardly and downwardly with the string and includes a tubular element to be connected to the upper end of the string for rotation therewith, a housing retained against rotation with said element, and motor means for power rotating said element and a connected string relative to said housing;

a powered torque wrench beneath said housing and including two sections for applying torque in opposite directions to said rotary element and an upper section of the drill string respectively and power means for relatively turning said two sections of the torque wrench to break a threaded connection between said rotary element and the drill string;

a mounting structure connected to said housing and retained thereby against rotation and projecting downwardly therefrom and carrying said torque wrench while maintaining it against rotation with said rotary element;

said last mentioned structure including a piston and cylinder mechanism for actuating said torque wrench upwardly and downwardly relative to said housing;

said element and one of said sections of the torque wrench having splines movable between interfitting and non-interfitting positions by said upward and downward movement of the torque wrench;

the other section of said torque wrench having gripping means actuable into and out of gripping engagement with an upper section of the drill string;

said element having an upwardly facing shoulder structure;

a carrier part disposed about said element above said shoulder structure and movable between a lower position of support by said shoulder structure, a second higher position, and a third still higher position near said housing;

torque arrester structures connected at their upper ends to said housing and projecting downwardly therefrom through passages in said carrier part in a relation retaining the carrier part against rotation with said element and guiding the carrier part for upward and downward movement between said three positions thereof;

said torque arrester structures containing springs yieldingly urging said carrier part upwardly from said lower first position to said second position;

suspension links connected to said carrier part and extending downwardly therefrom past said torque wrench; and an elevator suspended by said links beneath the torque wrench and movable upwardly and downwardly with the carrier part.

4. Well drilling apparatus as recited in claim 3, including an elongated flexible member connected at opposite ends thereof to said carrier part and extending upwardly therefrom and having an actuating portion, and a structure engageable by said actuating portion of said elongated flexible member when said top drive assembly and said torque wrench are lowered to a predetermined position and acting to prevent further downward movement of said actuating portion of the elongated member in a relation causing it to exert upward force on said carrier part and retract the carrier part and elevator upwardly relative to said housing to said third position of the carrier part.

5. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto;

a powered torque wrench operable to apply torque in opposite directions to said string and said element;

an elevator adapted to engage a section of said drill string at a location beneath the torque wrench and suspend said section for movement by the elevator;

connecting means adapted to attach said torque wrench and said elevator to said top drive assembly for movement upwardly and downwardly therewith and in a relation suspensing said torque wrench and said elevator and a section of the drill string carried by the elevator from said top drive assembly;

said connecting means being constructed to enable movement of said torque wrench and elevator vertically relative to one another.

6. A pipe handler for use with a top drive well drilling assembly which is movable upwardly and downwardly with and drives a drill string and includes a non-rotating body structure carrying motor means driving a rotary stem for turning the drill string, said pipe handler comprising:

an element adapted to be connected to the upper end of the drill string and turn it and adapted to be connected to and be driven by said stem of the top drive assembly;

a powered torque wrench operable to apply torque in opposite directions to said string and said element;

an elevator adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means including means for actuating said torque wrench upwardly and downwardly relative to said element between an active position in which portions of said torque wrench and said element interfit to retain said element against rotation relative to said portion of the torque wrench and a released position permitting such rotation.

7. Well drilling apparatus comprising:

a top drive assembly to be received at the upper end of a drill string and which is movable upwardly and downwardly with the string and includes a tubular element to be connected to the upper end of the string for rotation therewith, a housing retained against rotation with said element, and motor means for power rotating said element and a connected string relative to said housing;

a powered torque wrench beneath said housing and including two sections for applying torque in opposite directions to said rotary element and an upper section of the drill string respectively and power means for relatively turning said two sections of the torque wrench to break a threaded connection between said rotary element and the drill string;

a mounting structure connected to said housing and retained thereby against rotation and projecting downwardly therefrom and carrying said torque wrench while maintaining it against rotation with said rotary element;

said last mentioned structure including a piston and cylinder mechanism for actuating said torque wrench upwardly and downwardly relative to said housing;

said element and one of said sections of the torque wrench having splines movable between interfitting and non-interfitting positions by said upward and downward movement of the torque wrench;

the other section of said torque wrench having gripping means actuable into and out of gripping engagement with an upper section of the drill string;

said element having an upwardly facing shoulder structure;

a carrier part disposed about said element above said shoulder structure and movable between a lower position of support by said shoulder structure, a second higher position, and a third still higher position near said housing;

torque arrester structures connected at their upper ends to said housing and projecting downwardly therefrom through passages in said carrier part in a relation retaining the carrier part against rotation with said element and guiding the carrier part for upward and downward movement between said three positions thereof;

said torque arrester structures containing springs yieldingly urging said carrier part upwardly from said lower first position to said second position;

suspension links connected to said carrier part and extending downwardly therefrom past said torque wrench;

an elevator suspended by said links beneath the torque wrench and movable upwardly and downwardly with the carrier part;

an elongated flexible member connected at opposite ends thereof to said carrier part and extending upwardly therefrom and having an actuating portion; and a structure engageable by said actuating portion of said elongated flexible member when said top drive assembly and said torque wrench are lowered to a predetermined position and acting to block further downward movement of said actuating portion of the elongated element in a relation causing it to exert upward force on said carrier part and retract the carrier part and elevator upwardly relative to said housing to said third position of the carrier part.

8. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string to drill a well;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means being constructed to retain said torque wrench against rotation with said element and the drill string as said element and string are rotated by said motor means to drill a well;

said torque wrench and said element having portions which are relatively movable between active positions interfitting to prevent relative rotation between a section of the torque wrench and said element and inactive positions freeing said element for powered rotation relative to the torque wrench during drilling.

9. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string to drill a well;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means being constructed to retain said torque wrench against rotation with said element and the drill string as said element and string are rotated by said motor means to drill a well;

said element having a splined portion, and said torque wrench including a splined portion movable axially relative to said element between a position of interfitting engagement with said splined portion of said element to prevent rotation of said element relative to the torque wrench and a retracted position in which said two splined portions are not in interfitting relation and permit rotation of said element relative to the torque wrench during drilling.

10. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string to drill a well;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means being constructed to retain said torque wrench against rotation with said element and the drill string as said element and string are rotated by said motor means to drill a well;

said element having a splined portion, and said torque wrench having a first section with a splined portion movable into and out of interfitting relation with respect to said splined portion of said element, a second section adapted to grip the drill string and powered means for turning said sections relative to one another;

said connecting means including a power unit for actuating said torque wrench upwardly and downwardly between an active position in which said splined portions are in interfitting engagement to prevent rotation of said element relative to said first section of the torque wrench and an inactive position moving said splined portions out of engagement to permit rotation of said element during drilling of a well.

11. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator;

connecting means attaching said torque wrench and said elevator to said top drive assembly for movement upwardly and downwardly therewith and in a relation suspending said elevator and a section of the drill string carried thereby from said top drive assembly;

said connecting means being constructed to retain said elevator against rotation with said element and a drill string connected thereto as said element and drill string are power rotated by said motor means to drill a well;

said connecting means mounting said elevator for upward and downward movement relative to said torque wrench;

an elongated flexible element connected to said elevator; and a stop member positioned to automatically actuate said elongated element for pulling said elevator upwardly relative to and toward said torque wrench upon movement of said top drive assembly and torque wrench downwardly to a predetermined position.

12. Well drilling apparatus comprising:

a top drive assembly to be received at the upper end of a drill string and which is movable upwardly and downwardly with the string;

said assembly including an element to be connected to the upper end of the string for rotation thereiwth and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means being constructed to retain said elevator against rotation with said element and a drill string connected thereto as said element and drill string are power rotated by said motor means to drill a well;

said connecting means mounting said elevator for movement upwardly and downwardly relative to said torque wrench and said top drive assembly between a lower position in which the elevator is suspended by an enlargement on said rotary element, a second and higher position in which said element is rotatable relative to the elevator, and an upper retracted position higher than said second position;

said connecting means including means yieldingly urging said elevator upwardly from said first position to said second position.

13. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means being constructed to retain said elevator against rotation with said element and a drill string connected thereto as said element and drill string are power rotated by said motor means to drill a well;

said connecting means including a support shoulder structure carried by said element, a carrier part disposed about said element above said shoulder structure and from which said elevator is suspended and which is movable upwardly and downwardly between a lower position of support by said shoulder structure and an upper position in which said elevator is retracted upwardly relative to and toward said torque wrench.

14. Well drilling apparatus as recited in claim 13, in which said connecting means include torque arrester means extending downwardly from said top drive assembly and slidably received within aperture means in said carrier part to guide the carrier part for upward and downward movement while preventing rotation thereof.

15. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means being constructed to retain said elevator against rotation with said element and a drill string connected thereto as said element and drill string are power rotated by said motor means to drill a well;

said connecting means including a support shoulder structure carried by said element, a carrier part disposed about said element above said shoulder structure and from which said elevator is suspended and which is movable upwardly and downwardly relative to said element;

said top drive assembly having a non-rotating section;

said connecting means including torque arrester structures projecting downwardly from said non-rotating section of the top drive assembly and retained thereby against rotation and projecting through guideways in said carrier part in a relation guiding said carrier part for upward and downward movement relative to said element between a lower position of support by said shoulder structure, a higher position spaced above the shoulder structure, and a still higher third position in which said elevator is retracted upwardly toward said torque wrench, said torque arrester structures including springs yieldingly urging said carrier part upwardly to said second position.

16. Well drilling apparatus comprising:

a top drive assembly to be received at the upper end of a drill string and which is movable upwardly and downwardly with the string;

said assembly including an element to be connected to the upper end of the string for rotation therewith and motor means for power rotating said element and the connected string;

a powered torque wrench at the lower end of said assembly operable to apply torque in opposite directions to said string and said element;

an elevator at the lower end of said assembly adapted to engage a section of said drill string at a location beneath the torque wrench and suspend said section for movement by the elevator;

connecting means attaching said torque wrench and said elevator to said top drive assembly for movement upwardly and downwardly therewith and in a relation suspending said elevator and a section of the drill string carried thereby from said top drive assembly; and means automatically responsive to movement of said top drive drilling assembly and torque wrench to a predetermined lower position to retract said elevator upwardly relative to and toward the torque wrench.

17. Well drilling apparatus as recited in claim 16, in which said last mentioned means include an elongated flexible member movable upwardly and downwardly with said top drive assembly and operable to pull said elevator upwardly relative to the top drive assembly, and a structure engageable by a portion of said elongated flexible member when the top drive assembly is lowered to a predetermined position and acting to block further downward movement of said portion of said flexible member in a relation causing the latter to retract the elevator upwardly relative to and toward said torque wrench.

18. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto;

a powered torque wrench operable to apply torque in opposite directions to said string and said element;

an elevator adapted to engage a section of said drill string at a location beneath the torque wrench and suspend said section for movement by the elevator; and connecting means adapted to attach said torque wrench and said elevator to said top drive assembly for movement upwardly and downwardly therewith and in a relation suspending said elevator and a section of the drill string carried thereby from said top drive assembly;

said connecting means being constructed to retain said torque wrench against rotation with said element and the drill string as said element and string are rotated by said motor means to drill a well;

said torque wrench and said element having portions which are relatively movable between active positions interfitting to prevent relative rotation between a section of the torque wrench and said element and inactive positions freeing said element for powered rotation relative to the torque wrench during drilling.

19. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto;

a powered torque wrench operable to apply torque in opposite directions to said string and said element;

an elevator adapted to engage a section of said drill string at a location beneath the torque wrench and suspend said section for movement by the elevator; and connecting means adapted to attach said torque wrench and said elevator to said top drive assembly for movement upwardly and downwardly therewith and in a relation suspending said elevator and a section of the drill string carried thereby from said top drive assembly;

said connecting means being constructed to retain said torque wrench against rotation with said element and the drill string as said element and string are rotated by said motor means to drill a well;

said element having a splined portion, and said torque wrench having a first section with a splined portion movable into and out of interfitting relation with respect to said splined portion of said element, a second section adapted to grip the drill string, and powered means for turning said sections relative to one another;

said connecting means including a power unit for actuating said torque wrench upwardly and downwardly between an active position in which said splined portions are in interfitting egnagement to prevent rotation of said element relative to said first section of the torque wrench and an inactive position moving said splined portions out of engagement to permit rotation of said element during drilling of a well.

20. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto;

a powered torque wrench operable to apply torque in opposite directions to said string and said element;

an elevator adapted to engage a section of said drill string at a location beneath the torque wrench and suspend said section for movement by the elevator; and connecting means adapted to attach said torque wrench and said elevator to said top drive assembly for movement upwardly and downwardly therewith and in a relation suspending said elevator and a section of the drill string carried thereby from said top drive assembly;

said connecting means being constructed to retain said elevator against rotation with said element and a drill string connected thereto as said element and drill string are power rotated by said motor means to drill a well;

said connecting means mounting said elevator for movement upwardly and downwardly relative to said torque wrench and said top drive assembly between a lower position in which the elevator is suspended by a shoulder on said rotary element, a second and higher position in which said element is rotatable relative to the elevator, and an upper retracted position higher than said second position, said connecting means including means yieldingly urging said elevator upwardly from said first position to said second position.

21. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto;

a powered torque wrench operable to apply torque in opposite directions to said string and said element;

an elevator adapted to engage a section of said drill string at a location beneath the torque wrench and suspend said section for movement by the elevator; and connecting means adapted to attach said torque wrench and said elevator to said top drive assembly for movement upwardly and downwardly therewith and in a relation suspending said elevator and a section of the drill string carried thereby from said top drive assembly;

said connecting means being constructed to retain said elevator against rotation with said element and a drill string connected thereto as said element and drill string are power rotated by said motor means to drill a well;

said connecting means including a support shoulder structure carried by said element, and a carrier part disposed about said element above said shoulder structure and from which said elevator is suspended and which is movable upwardly and downwardly between a lower position of support by said shoulder structure and an upper position in which said elevator is retracted upwardly relative to and toward said torque wrench.

22. A well pipe handler as recited in claim 21, in which said connecting means include torque arrester means extending downwardly from said top drive assembly and slidably received within aperture means in said carrier part to guide the carrier part for upward and downward movement while preventing rotation thereof.

23. A well pipe handler as recited in claim 21, in which said connecting means include torque arrester means projecting downwardly from said non-rotating body structure of the top drive assembly through aperture means in said carrier part and slidably guiding the carrier part for upward and downward movement between said two positions, and yielding means urging said carrier part upwardly to an intermediate third position.

24. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto;

a powered torque wrench operable to apply torque in opposite directions to said string and said element;

an elevator adapted to engage a section of said drill string at a location beneath the torque wrench and suspend said section for movement by the elevator;

connecting means adapted to attach said torque wrench and said elevator to said top drive assembly for movement upwardly and downwardly therewith and in a relation suspending said elevator and a section of the drill string carried thereby from said top drive assembly;

said connecting means being constructed to enable downward movement of said torque wrench relative to and toward said elevator to bring the torque wrench and elevator closer vertically together in lower positions thereof;

an elonaged flexible member movable upwardly and downwardly with said top drive assembly and operable to pull said elevator upwardly relative to the top drive assembly; and a structure engageable by a portion of said elongated flexible member when the top drive assembly is lowered to a predetermined position and acting to block further downward movement of said portion of said flexible member in a relation causing the latter to retract the elevator upwardly relative to and toward said torque wrench.

25. Well drilling apparatus comprising:

a top drive assembly to be received at the upper end of a drill string and which is movable upwardly and downwardly with the string;

said assembly including an element to be connected to the upper end of the string for rotation therewith, a body which does not turn with said element, and motor means for power rotating said element and the connected string relative to said body;

a powered torque wrench at the lower end of said assembly operable to apply torque in opposite directions to said string and said element;

an elevator at the lower end of said assembly and beneath said torque wrench and adapted to engage a section of said drill string beneath the torque wrench and suspend said section for movement by the elevator; and connecting means attaching said torque wrench and said elevator to said top drive assembly for movement upwardly and downwardly therewith and in a relation suspending said elevator and a section of the drill string carried thereby from said top drive assembly;

said connecting means including a structure which is attached to said body of the top drive assembly for movement upwardly and downwardly therewith and which is retained by said body against rotation with said element and which extends downwardly past said torque wrench to said elevator and retains the elevator against rotation.

26. Well drilling apparatus as recited in claim 25, in which said structure includes a part received about said element above the torque wrench and which is retained against rotation with said element, and link means suspended by said part and extending downwardly past said torque wrench and suspending the elevator therebeneath.

27. Well drilling apparatus as recited in claim 25, in which said structure which retains said elevator against rotation is constructed to permit upward and downward movement of said elevator relative to said body of the top drive assembly.

28. Well drilling apparatus as recited in claim 25, in which said structure includes a part received at the outside of said element above the torque wrench and movable upwardly and downwardly relative thereto, link means suspended by said part and extending downwardly past the torque wrench and suspending the elevator therebeneath, and torque arrester means connected to said body of the top drive assembly and retaining said part against rotation with said element.

29. Well drilling apparatus as recited in claim 28, in which said part and said element have portions coacting to support said part and said link means and said elevator and a drill string carried thereby from said element in one position of said part.

30. Well drilling apparatus as recited in claim 25, in which said structure has a portion adapted to suspend said elevator from said element which is driven rotatably by said motor means when said element is not rotating but constructed to permit rotation of said element and a connected string relative to the elevator during drilling of a well.

31. Well drilling apparatus as recited in claim 25, in which said structure permits movement of said torque wrench and elevator vertically relative to one another while retaining the elevator against rotation.

32. Well drilling apparatus as recited in claim 25, including means for automatically retracting said elevator upwardly relative to and toward said torque wrench in response to movement of said top drive assembly and carried torque wrench downwardly to a predetermined position.

33. A well pipe handler for use with a top drive well drilling assembly which is movable upwardly and downwardly with and drives a drill string and which includes a non-rotating body structure carrying motor means for turning the string, said pipe handler comprising:

an element adapted to be driven rotatively by said motor means and to be connected to the upper end of the string to transmit rotation thereto, a powered torque wrench operable to apply torque in opposite directions to said string and said element;

an elevator adapted to engage a section of said drill string at a location beneath the torque wrench and suspend said section for movement by the elevator;

connecting means adapted to attach said torque wrench and said elevator to said top drive assembly for movement upwardly and downwardly therewith and in a relation suspending said elevator and a section of the drill string carried thereby from said top drive assembly; and means automatically responsive to movement of said top drive drilling assembly and torque wrench to a predetermined lower position to retract said elevator upwardly relative to and toward the torque wrench.

34. A well pipe handler for use with a top drive well drilling assembly which is movable upwardly and downwardly with and drives a drill string and which includes motor means for turning the string, and a body which does not rotate with the string, said pipe handler comprising:

an element adapted to be driven rotatively by said motor means relative to said body and to be connected to the upper end of the string to transmit rotation thereto;

a powered torque wrench operable to apply torque in opposite directions to said string and said element;

an elevator beneath said torque wrench and adapted to engage a section of said drill string beneath the torque wrench and suspend said section for movement by the elevator; and connecting means adapted to attach said torque wrench and said elevator to said top drive assembly for movement upwardly and downwardly therewith and in a relation suspending said elevator and a section of the drill string carried thereby from said top drive assembly;

said connecting means including a structure which is adapted to be attached to said body of the top drive assembly for movement upwardly and downwardly therewith and to be retained by said body against rotation with said element and which extends downwardly past said torque wrench to said elevator and retains the elevator against rotation.

35. A well pipe handler as recited in claim 34, in which said structure includes a part received about said element above the torque wrench and which is retained against rotation with said element, and link means suspended by said part and extending downwardly past said torque wrench and suspending the elevator therebeneath.

36. A well pipe handler as recited in claim 34, in which said structure which retains said elevator against rotation is constructed to permit upward and downward movement of said elevator relative to said body of the top drive assembly.

37. A well pipe handler as recited in claim 34, in which said structure includes a part received at the outside of said element above the torque wrench and movable upwardly and downwardly relative thereto, link means suspended by said part and extending downwardly past the torque wrench and suspending the elevator therebeneath, and torque arrester means adapted to be connected to said body of the top drive assembly and retaining said part against rotation with said element.

38. A well pipe handler as recited in claim 34, in which said part and said element have portions coacting to support said part and said link means and said elevator and a drill string carried thereby from said element in one position of said part.

39. A well pipe handler as recited in claim 34, in which said structure has a portion adapted to suspend said elevator from said element which is driven rotatably by said motor means when said element is not rotating but to permit rotation of said element and a connected string relative to the elevator during drilling of a well.

40. A well pipe handler as recited in claim 34, in which said structure permits movement of said torque wrench and elevator vertically relative to one another while retaining the elevator against rotation.

* * * * *